US011835321B2

(12) United States Patent
Foster

(10) Patent No.: US 11,835,321 B2
(45) Date of Patent: Dec. 5, 2023

(54) BALLISTIC PROTECTION MATERIAL

(71) Applicant: Advanced Matrix Composite Systems Limited, London (GB)

(72) Inventor: Tom Foster, London (GB)

(73) Assignee: Advanced Matrix Composite Systems Limited, London (GB)

( * ) Notice: Subject to any disclaimer, the term of this patent is extended or adjusted under 35 U.S.C. 154(b) by 0 days.

(21) Appl. No.: 17/771,291

(22) PCT Filed: Oct. 23, 2020

(86) PCT No.: PCT/GB2020/052689
§ 371 (c)(1),
(2) Date: Apr. 22, 2022

(87) PCT Pub. No.: WO2021/079144
PCT Pub. Date: Apr. 29, 2021

(65) Prior Publication Data

US 2022/0397373 A1 Dec. 15, 2022

(30) Foreign Application Priority Data

Oct. 25, 2019 (GB) ..... 1915727

(51) Int. Cl.
*F41H 5/04* (2006.01)

(52) U.S. Cl.
CPC ..... *F41H 5/0428* (2013.01); *F41H 5/0421* (2013.01); *F41H 5/0457* (2013.01)

(58) Field of Classification Search
CPC ..... F41H 5/0428; F41H 5/0421; F41H 5/0457
(Continued)

(56) References Cited

U.S. PATENT DOCUMENTS 4,292,882 A * 10/1981 Clausen ..... B32B 5/26 109/81
8,096,223 B1 * 1/2012 Andrews ..... F41H 5/0492 89/36.02

(Continued)

FOREIGN PATENT DOCUMENTS

EP 0910689 B1 12/2000
WO 2006/048870 A1 5/2006

(Continued)

OTHER PUBLICATIONS

International Search Report and Written Opinion received in PCT/GB2020/052689 dated Mar. 26, 2021, 18 pages.

*Primary Examiner* — Samir Abdosh
(74) *Attorney, Agent, or Firm* — Meunier Carlin & Curfman LLC

(57) ABSTRACT

A ballistic protection material (10) having a composite layer (16) that comprises a mesh (54) embedded in a mass of compacted particulate material (56) that is bound together by a binder material (66). The mesh (54) may be a metal mesh, the particulate material (56) may comprise ceramic particles (64) and the binder material (66) may be an epoxy resin matrix. The ballistic protection material (10) may comprise additional layers, for example, a first layer (12) comprising a first class of steel and a second layer (14) comprising a second class of steel that is different to the first class of steel. The second layer (14) can be positioned intermediate the first layer (12) and the composite layer (16).

20 Claims, 7 Drawing Sheets

Figure 1:
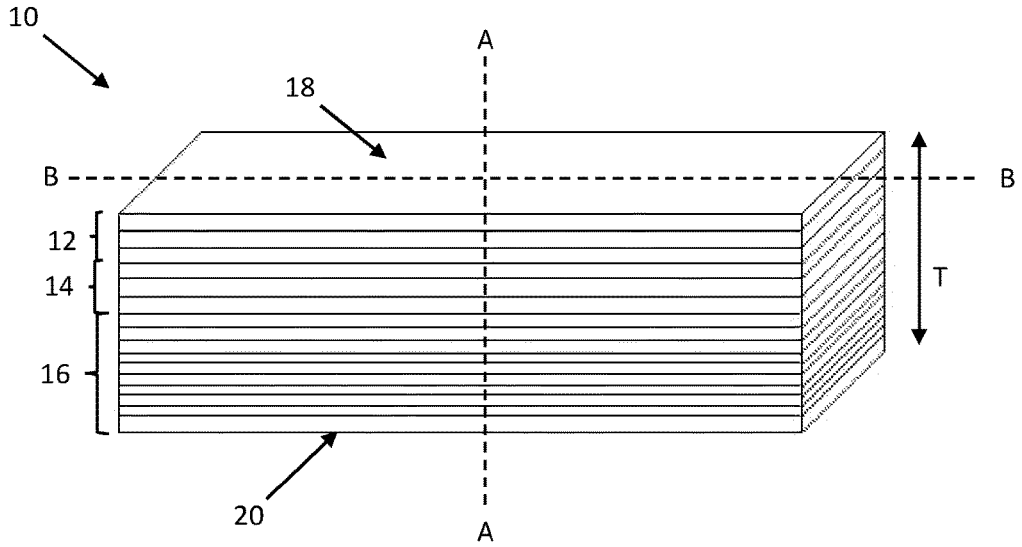

(58) Field of Classification Search
USPC ..... 89/36.02
See application file for complete search history.

(56) References Cited

U.S. PATENT DOCUMENTS

| | | | | |
|---|---|---|---|---|
| 9,207,048 | B1 * | 12/2015 | Roland | F41H 5/0492 |
| 2003/0161750 | A1 * | 8/2003 | Moxson | C22C 32/00 148/421 |
| 2009/0095147 | A1 * | 4/2009 | Tunis | F41H 5/013 89/36.02 |
| 2010/0229714 | A1 * | 9/2010 | Tonyan | B28B 5/027 89/36.02 |
| 2012/0180636 | A1 * | 7/2012 | Seuk | F41H 5/08 89/926 |
| 2012/0204711 | A1 * | 8/2012 | Engleman | F41H 5/013 89/937 |
| 2012/0219749 | A1 * | 8/2012 | Leighton | C04B 35/63424 428/68 |
| 2018/0010890 | A1 * | 1/2018 | Waldrop | F41H 5/0492 |

FOREIGN PATENT DOCUMENTS

| | | | | |
|---|---|---|---|---|
| WO | WO-2008046152 | A1 * | 4/2008 | C03C 14/002 |
| WO | 2009/120179 | A1 | 10/2009 | |
| WO | WO-2015179013 | A2 * | 11/2015 | F41H 1/00 |

* cited by examiner

BALLISTIC PROTECTION MATERIAL

CROSS REFERENCE TO RELATED APPLICATIONS

This application is a United States National Phase Patent Application of International Patent Application Number PCT/GB2020/052689, filed on Oct. 23, 2020, which claims the benefit of priority to GB Application No. 1915727.0, filed Oct. 25, 2019, the contents of which are incorporated by reference herein in their entireties.

The present invention is concerned with a ballistic protection material. More particularly, the present invention is concerned with an improved ballistic protection material that may be used to protect personnel, buildings and vehicles such as tanks and armoured personnel carriers from ballistic threats. The present invention has successfully defended against normal and armour piercing ammunition.

Ballistic protection materials are used to protect personnel, buildings and vehicles such as tanks and armoured personnel carriers, aircraft, trains, boats and other vessels, from damage caused by ballistic threats such as armour piercing ammunition and other projectiles. The current ballistic tests include those identified under reference EN1522/1523 for Europe and STANAG 4569 within NATO. The invention has successfully defended against normal and armour piercing ammunition within these standards.

Current ballistic protection materials of the type referred to above often suffer the disadvantage of being heavy, expensive to manufacture and much thicker than might be desired for effective deployment.

In view of the above, there still exists a requirement for ballistic protection material which is less costly and more effective than present materials whilst also, potentially, being thinner and lighter than existing materials for the same ballistic resistance. The present invention aims at solving these problems whilst employing readily available low cost materials and a manufacturing process that makes use of readily available equipment.

According to one aspect of the present invention there is provided a ballistic protection material having a composite layer comprising a mesh embedded in a mass of compacted particulate material bound together by a binder material.

Advantageously, the particulate material helps arrest the progress of a projectile by a displacement mechanism which makes use of one or more of: structural failure of individual particles of particulate material, movement of individual particles of the particulate material relative to adjacent particles of said material; or breaking of the bond between particles of the particulate material formed by the binder material.

Preferably, the mesh comprises at least one sheet of mesh and the at least one sheet of mesh includes a plurality of filaments.

Preferably, the mesh comprises a plurality of sheets of mesh.

Preferably, the plurality of filaments within a sheet of mesh are connected together and preferably are woven.

More preferably, the mesh is a metal mesh or made of metal alloy material. The mesh could be made from a non-metallic material provided that it has the material properties required to give structural integrity to the composite layer and impede the progress of a projectile through the composite layer in the desired manner i.e. retention of high tensile strength at the heat levels which are a likely to arise on impact.

Preferably, the filaments of the at least one sheet of mesh are metal wires with a diameter of at least 0.25 millimetre, more preferably of at least 0.3 millimetres, and more preferably less than 1 millimetre. The mesh aperture is suitably equal to or greater than 0.5 millimetre. The mesh aperture is suitably equal to or less than 1.5 millimetres.

Preferably, the mesh is made from aluminium, or titanium, or stainless steel.

Preferably, the particulate material comprise particles made from a ceramic material.

Preferably, the particulate material comprise particles made from aluminium oxide.

Preferably, the particles of aluminium oxide are particles of crystalline aluminium oxide.

Preferably, the average particle size of the particles is at least 0.25 millimetres.

Preferably, the average particle size of the particles is less than 0.90 millimetres, or more preferably less than 0.75 millimetres.

Preferably, the particles of aluminium oxide are generally spherical.

Preferably, the particles of aluminium oxide are angular.

Preferably, the mesh is a metal mesh or metal alloy mesh, wherein the compacted particulate material comprises ceramic particles, wherein the binder material is a matrix and wherein the metal mesh and the ceramic particles are embedded in the matrix.

Preferably, the matrix includes a polymer, for example a polyepoxide such as an epoxy resin.

Preferably, the ballistic protection material has a first layer comprising a first material, a second layer comprising a second material and a third layer comprising the composite layer.

Preferably, the second layer is positioned intermediate the first layer and the third layer.

Preferably, the first layer includes a plurality of partially overlapping panels of the first material.

Preferably, the plurality of partially overlapping panels of the first material are arranged in two or more overlaid sheets.

Preferably, the first material is selected from the list: carbon steel, high carbon steel, carbon fibre, ultra-high-molecular-weight-polyethylene (UHMWPE), aramid fibres.

Preferably, the first material of the first layer comprises a first class of steel, and the second material of the second layer comprises a second class of steel that is different to the first class of steel.

Preferably, the second layer includes a plurality of sheets of the second material.

Preferably, the second layer includes at least three sheets of the second material.

Preferably, the second material is selected from the list: tool steel, high speed steel, carbon steel, high carbon steel, carbon fibre, ultra-high-molecular-weight-polyethylene (UHMWPE), aramid fibres.

Preferably, the first layer has a first thickness, the second layer has a second thickness, and wherein the ratio of the first thickness to the second thickness is 1:2.

Preferably, the third layer has a third thickness and the ratio of the second thickness to the third thickness is 1:2.

Preferably, the ratio of the first thickness to the third thickness is 1:4.

Preferably, the first thickness is approximately 5 millimetres.

Preferably, the second thickness is approximately 10 millimetres.

Preferably, the third thickness is approximately 20 millimetres.

The thickness of the first layer, the second layer and/or the third layer may be modified according to the requirements of the specific threat environment for which the ballistic protection material is to be used.

Preferably, the first thickness, the second thickness and the third thickness have a combined thickness that is less than 50 millimetres.

Figure 2A:
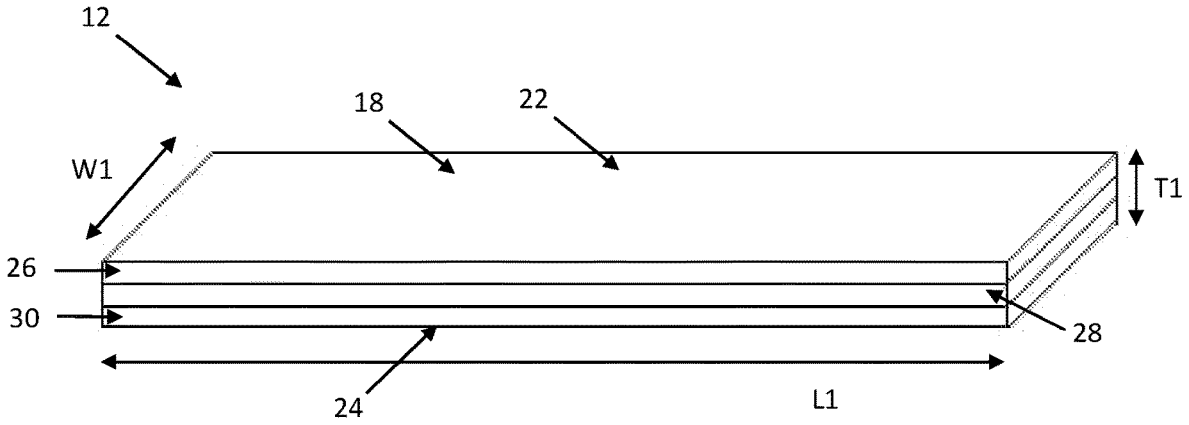
Figure 2B:
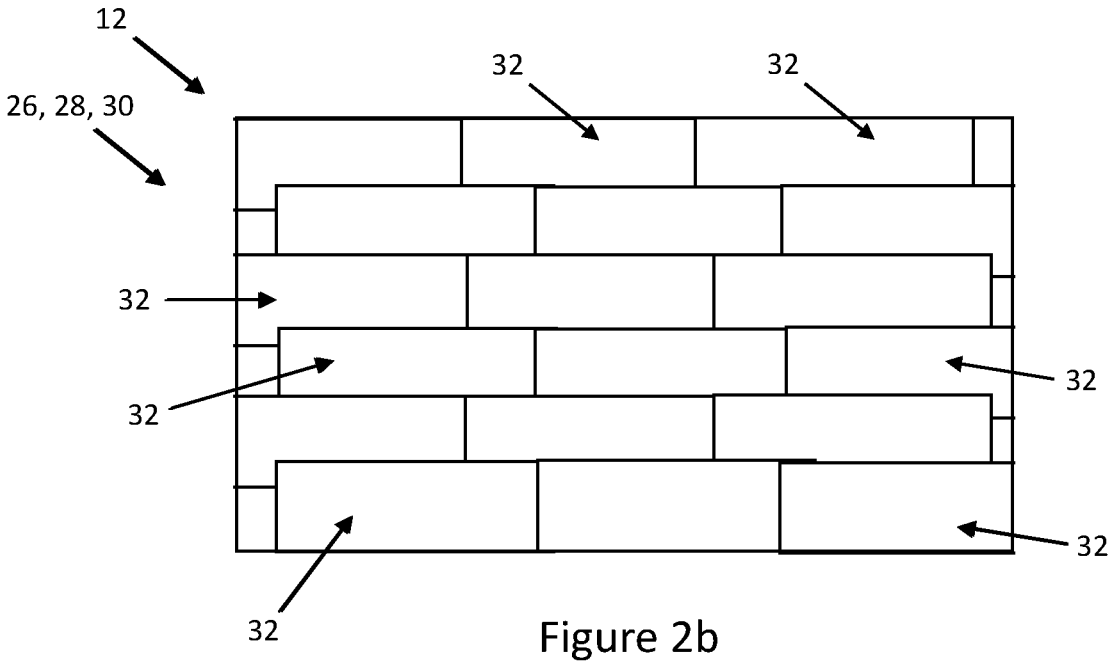

An example according to the present invention will now be described with reference to the accompanying Figures, in which:

FIG. 1 is a schematic perspective view of a ballistic protection material according to the present invention;

FIG. 2*a* is a schematic perspective view of a first layer of the ballistic protection material of FIG. 1;

FIG. 2*b* is a schematic plan view of a sheet of the first layer of FIG. 2*a;*

Figure 2C:
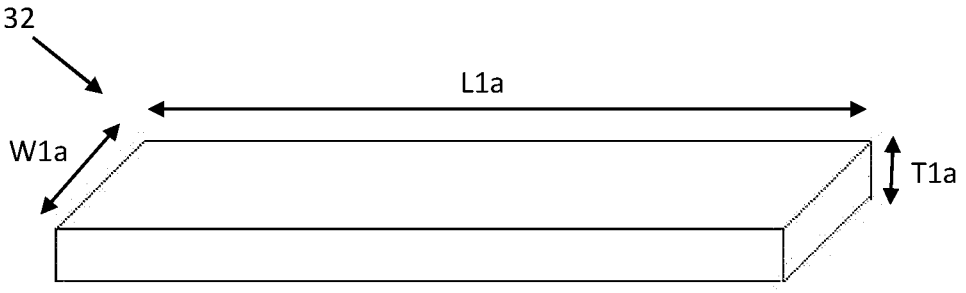

FIG. 2*c* is a schematic perspective view of a panel of the sheet of FIG. 2*b;*

Figure 3A:
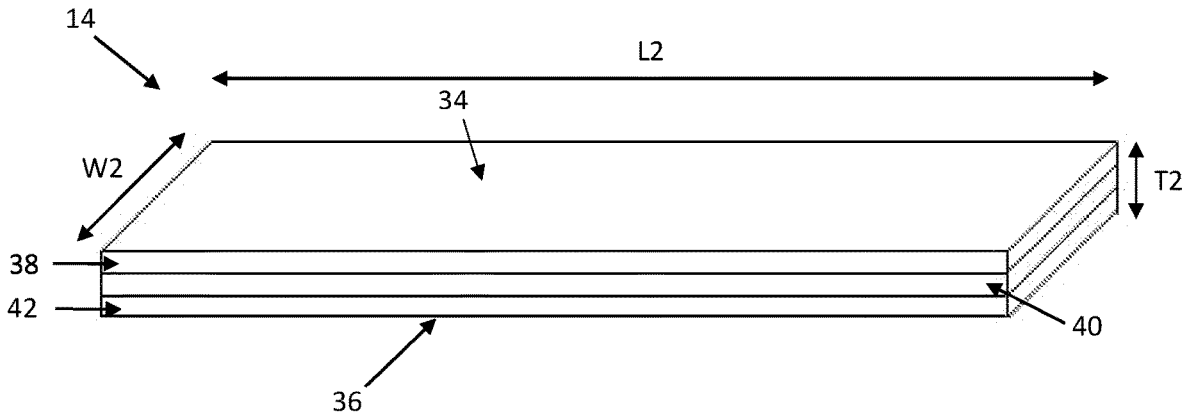
Figure 3B:
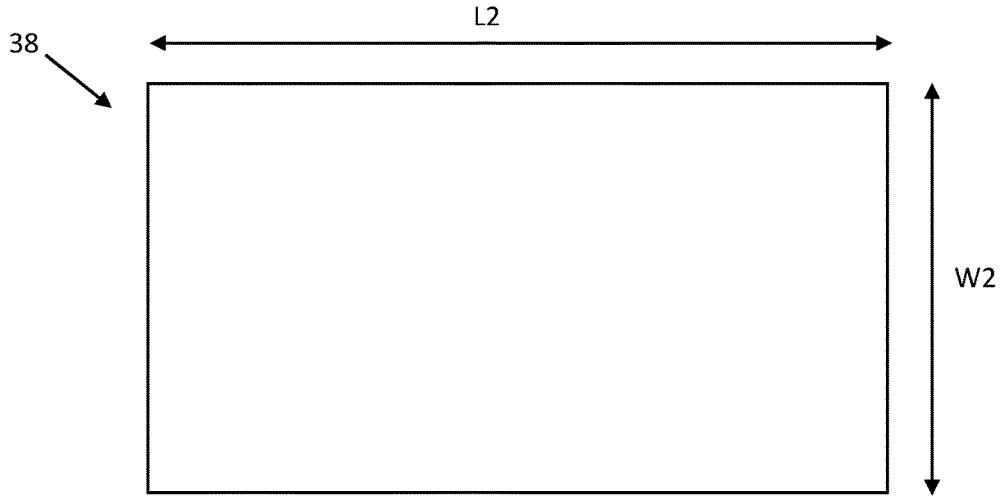

FIG. 3*a* is a schematic perspective view of a second layer of the ballistic protection material of FIG. 1;

FIG. 3*b* is a schematic plan view of a first sheet of the second layer of FIG. 3*a;*

Figure 3C:
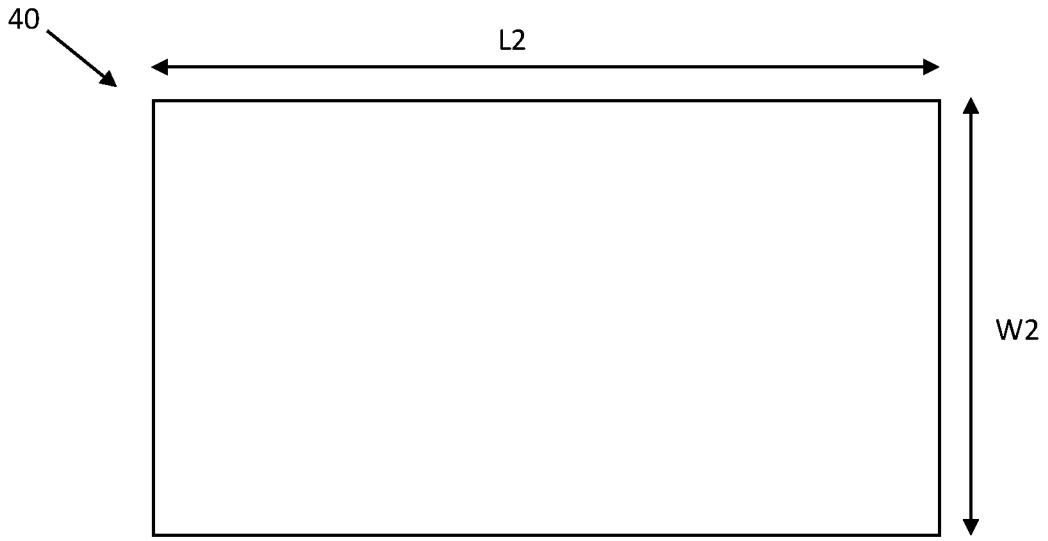

FIG. 3*c* is a schematic plan view of a second sheet of the second layer of FIG. 3*a;*

Figure 3D:
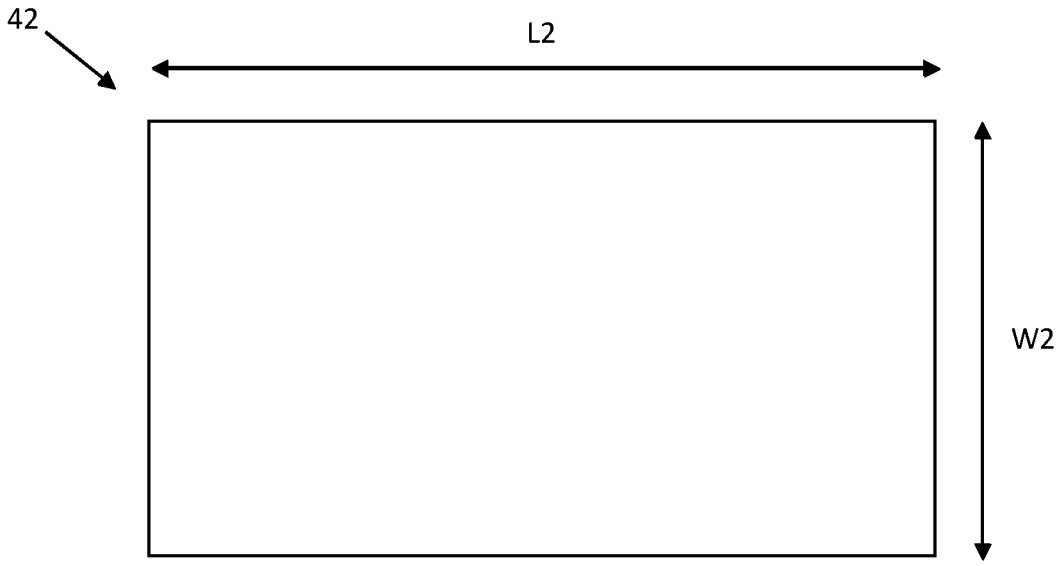

FIG. 3*d* is a schematic plan view of a third sheet of the second layer of FIG. 3*a;*

Figure 4A:
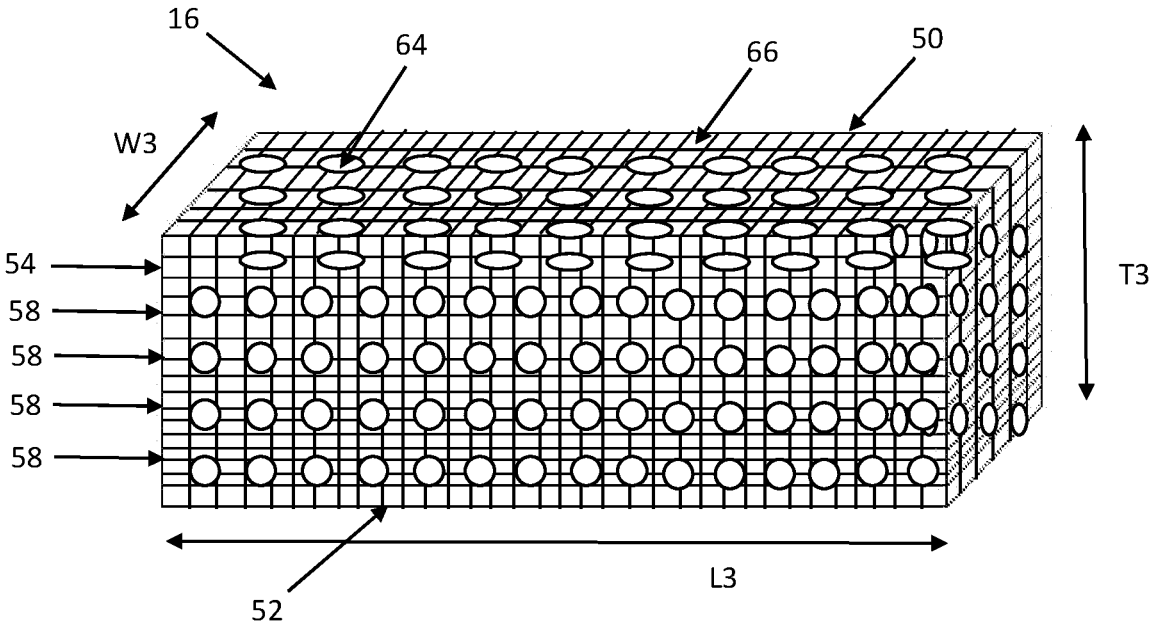
Figure 4B:
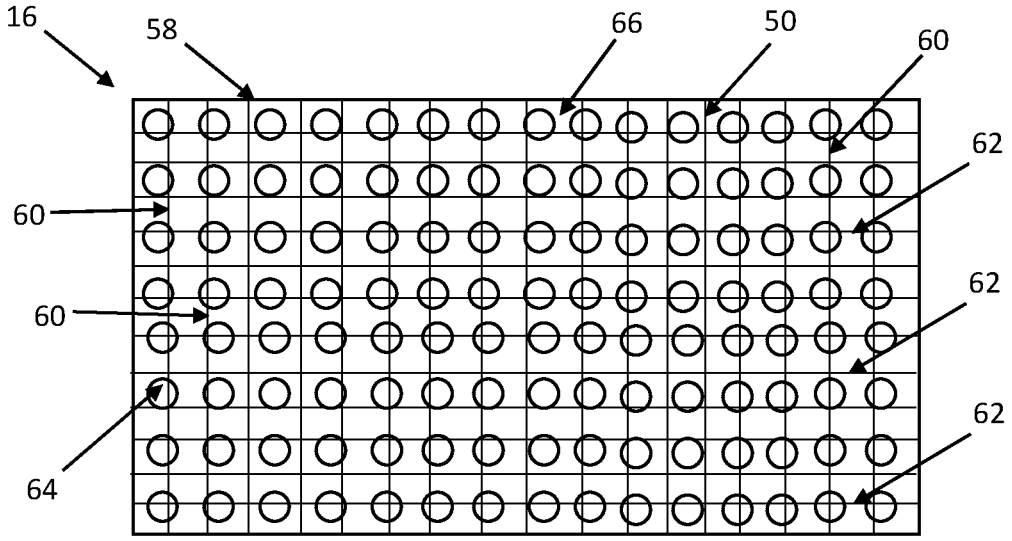

FIG. 4*a* is a schematic perspective view of a third layer of the ballistic protection material of FIG. 1;

FIG. 4*b* is a schematic plan view of the third layer of FIG. 4*a;*

Figure 4C:
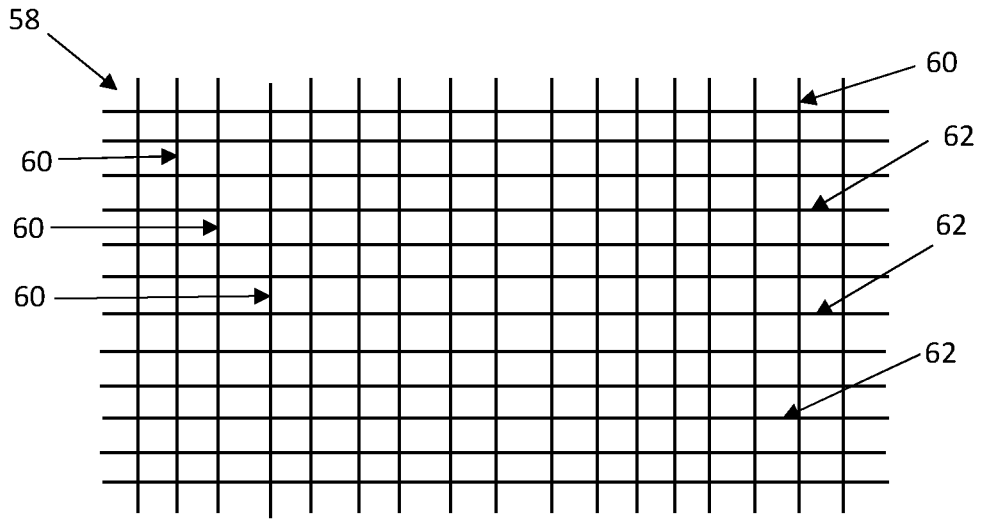

FIG. 4*c* is a schematic plan view of a sheet of the metal mesh of the third layer of FIG. 4*a;*

Figure 4D:
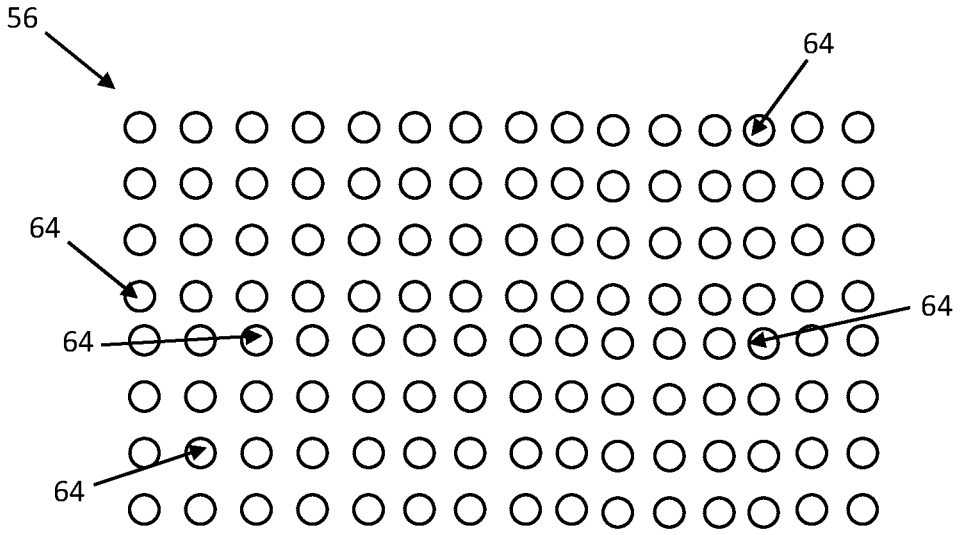

FIG. 4*d* is a schematic plan view of a particulate ceramic of the third layer of FIG. 4*a;*

Figure 4E:
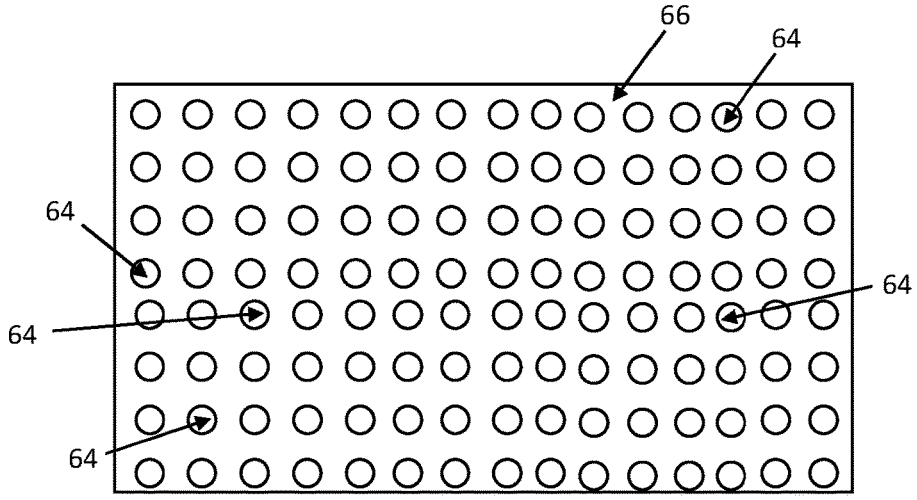
Figure 5:
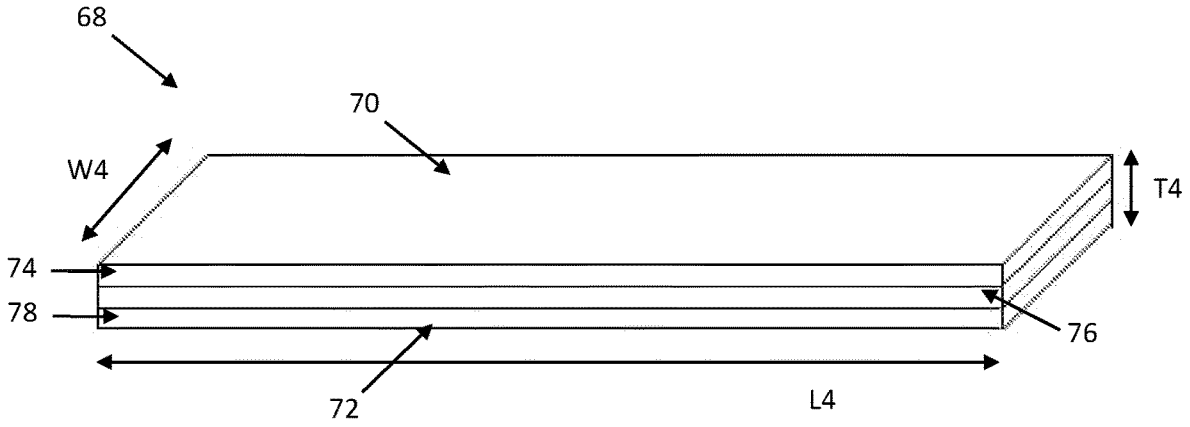

FIG. 4*e* is a schematic plan view of the particulate ceramic of FIG. 4*d* within a polymer matrix; and FIG. 5 is a backing layer for use with the ballistic protection material of FIG. 1.

Referring to FIG. 1, there is a ballistic protection material 10 according to the present invention. The ballistic protection material 10 includes a first layer 12, a second layer 14 and a third layer 16.

The ballistic protection material 10 has an outer or exterior face 18 and an inner or interior face 20. The outer face 18 and the inner face 20 are separated by a distance that corresponds to the thickness T of the material 10. The ballistic protection material 10 also has a longitudinal axis A-A and a transverse axis B-B.

With reference to FIG. 2*a*, the first layer 12 has an outer or exterior face 22, which corresponds to the outer or exterior face 18 of the ballistic protection material 10, and an inner or interior face 24. The outer face 22 and the inner face 24 are separated by a distance that corresponds to the thickness T1 of the first layer 12.

In an exemplary embodiment of the invention, the first layer 12 is generally cuboidal and has a length L1 that extends in a direction that is parallel to the transverse axis B-B of the material 10 and a width W1 that extends in a direction that is perpendicular to the transverse axis B-B of the material 10.

The first layer 12 has a first sheet 26, a second sheet 28 and a third sheet 30. The first sheet 26 overlaps, or overlays, the second sheet 28 and the second sheet 28 overlaps, or overlays, the third sheet 30 such that the second sheet 28 is positioned intermediate, or in between, the first sheet 26 and the third sheet 30.

Referring now to FIG. 2*b*, each of the first sheet 26, the second sheet 28 and the third sheet 30 include a plurality of panels 32.

The panels 32 are made from carbon steel, for example high carbon steel having a carbon content in the range 0.6 to 1.0 weight percent.

In an exemplary embodiment of the invention, as shown in FIG. 2*c*, the panels 32 may be generally cuboid and have a length L1*a* of approximately 60 millimetres, a width W1*a* of approximately 20 millimetres and a thickness T1*a* of approximately 1 millimetre.

Each panel 32 of the plurality of panels at least partially overlaps one or more of the adjacent panels 32 such that the plurality of at least overlapping panels 32 each form a sheet 26, 28, 30. Each of the sheets 26, 28, 30 are positioned to overlap each other such that the thickness T1 of the first layer is approximately 5 millimetres.

The second layer 14 will now be described with reference to FIGS. 3*a* to 3*d*.

The second layer 14 has an outer or exterior face 34 and an inner or interior face 36. The outer face 34 and the inner face 36 are separated by a distance that corresponds to the thickness T2 of the second layer 14. In an exemplary embodiment of the invention, the second layer 14 is generally cuboidal and has a length L2 that extends in a direction that is parallel to the transverse axis B-B of the material 10 and a width W2 that extends in a direction that is perpendicular to the transverse axis B-B of the material 10.

The second layer 14 has a first sheet 38, a second sheet 40 and a third sheet 42. The first sheet 38 overlaps, or overlays, the second sheet 40 and the second sheet 40 overlaps, or overlays, the third sheet 42 such that the second sheet 40 is positioned intermediate, or in between, the first sheet 38 and the third sheet 42.

Referring now to FIG. 3*b*, the first sheet 38 is a first planar sheet of material.

With reference to FIG. 3*c*, the second sheet 40 is a second planar sheet of material.

With reference to FIG. 3*d*, the third sheet 42 is a third planar sheet of material.

The sheets 38, 40, 42 of the second layer 14 are made from a different class or type of steel to the panels 32 of the first layer 12. The sheets 38, 40, 42 are made from a tool steel such as high strength steel, for example high strength steel including molybdenum in the range 8 weight percent to 10 weight percent.

In one embodiment of the invention, the sheets 38, 40, 42 are made from a high speed steel including 1.1 weight percent carbon, 3.75 weight percent chromium, 9.5 weight percent molybdenum, 1.5 weight percent tungsten, 1.15 weight percent vanadium and 8 weight percent cobalt.

Each of the sheets 38, 40, 42 are positioned to overlap, or overlay, each other such that the thickness T2 of the second layer 14 is approximately 10 millimetres.

The third layer 16 will now be described with reference to FIGS. 4*a* to 4*e*.

The third layer 16, or composite layer, has an outer or exterior face 50 and an inner or interior face 52. The outer face 50 and the inner face 52 are separated by a distance that corresponds to the thickness T3 of the third layer 16. In an exemplary embodiment of the invention, the third layer 16 is generally cuboidal and has a length L3 that extends in a direction that is parallel to the transverse axis B-B of the material 10 and a width W3 that extends in a direction that is perpendicular to the transverse axis B-B of the material 10.

The third layer 16 includes a combination of a metal mesh 54 and particulate ceramic 56 which are combined as described below such that the thickness T3 of the third layer 16 is approximately 20 millimetres.

The metal mesh 54 includes a plurality of mesh sheets 58. Each of the mesh sheets 58 includes a plurality of longitudinal wires 60 that extend in the first direction (the direction that extends across the width W3 of the third layer 16). In other words, the first direction in which the wires 60 extend is perpendicular to the transverse axis B-B of the material 10. Each of the mesh sheets 58 also includes a plurality of transverse wires 62 that extend in the second direction (the direction that extends across the length L3 of the third layer 16). In other words, the second direction in which the transverse wires 62 extend is parallel to the transverse axis B-B of the material 10. The first direction, in which the longitudinal wires 60 of the mesh sheet 58 extend, is different to the second direction, in which the transverse wires 62 of the mesh sheet 58 extend. The first direction, in which the longitudinal wires 60 of the mesh sheet 58 extend, is perpendicular to the second direction, in which the transverse wires 62 of the mesh sheet 58 extend.

The wires 60, 62 of the metal mesh or alloy metal mesh may include aluminium or titanium or stainless steel. Each of the wires may have a diameter of at least 0.25 millimetres, preferably at least of 0.3 millimetres. The mesh aperture range is suitably of 0.5 millimetre to 1.5 millimetre, preferably 1 millimetre. The mesh is preferably woven.

The particulate ceramic 56 is a plurality of separate particles 64 of a ceramic material. The particles 64 of the material may be generally spherical but may also be of an irregular shape including angular projections or angular corners. The particles 64 of the ceramic material have an average particle size that is at least 0.25 millimetres and that is less than 0.90 millimetres.

The ceramic material includes aluminium oxide, for example a crystalline form of aluminium oxide which is known as corundum.

In an embodiment of the invention, the third layer 16 also includes a matrix 66 in which the metal mesh 54 and the particulate ceramic 56 are embedded. The matrix may include a polymer, for example a polyepoxide such as epoxy resin.

The ballistic protection material 10 may also include a backing layer 68, as shown in FIG. 5. The backing layer 68 has an outer or exterior face 70 and an inner or interior face 72. The outer face 70 and the inner face 72 are separated by a distance that corresponds to the thickness T4 of the backing layer 68.

The backing layer 68 is generally cuboidal and has a length L4 that extends in a direction that is parallel to the transverse axis B-B of the material 10 and a width W4 that extends in a direction that is perpendicular to the transverse axis B-B of the material 10.

The backing layer 68 has a first sheet 74, a second sheet 76 and a third sheet 78. The first sheet 74 overlaps the second sheet 76 and the second sheet 76 overlaps, or overlays, the third sheet 78 such that the second sheet 76 is positioned intermediate, or in between, the first sheet 74 and the third sheet 78. The thickness T4 of the backing layer 68 is approximately 12 millimetres.

Each sheet 74, 76, 78 of the backing layer 68 includes aluminium, for example an aluminium alloy including zinc and/or magnesium and/or copper or could be a polymer, such as an aramid, ultra-high-molecular-weight-polyethylene (UHMWPE), carbon fibre or fibreglass. The aluminium of the backing layer 68 may be heat treated, for example tempered.

Manufacture of the ballistic protection material 10 will now be described.

The first layer 12 of the ballistic protection material 10 is manufactured as follows.

A first panel 32 of carbon steel is adhered to a second panel 32 of carbon steel using any suitable adhesive or bonding agent, for example an adhesive tape or an epoxy resin, such that the second panel 32 at least partially overlaps the first panel 32. A third panel 32 of carbon steel is adhered to the second panel 32 using a suitable adhesive such that the third panel 23 at least partially overlaps the second panel 32. A fourth panel 32 of carbon steel is adhered to the third panel 32 using a suitable adhesive such that the fourth panel 32 at least partially overlaps the third panel 32. This process is repeated until the first sheet 26 of the first layer 12 is formed. In one example of the invention, each panel overlaps at least 50% of the surface area of the panel next to it.

The process is repeated to form the second sheet 28 and the third sheet 30 of the first layer 12.

The second sheet 28 is adhered to the third sheet 30 using any suitable adhesive or bonding agent, for example an adhesive tape or epoxy resin, such that the second sheet 28 fully overlaps, or overlays, the third sheet 30. Similarly, the first sheet 26 is adhered to the second sheet 28 using a suitable adhesive such that the first sheet 26 fully overlaps the second sheet 28. In this way, the second sheet 28 is fastened in position between the first sheet 26 and the third sheet 30. The uppermost surface of the first sheet 26 thus becomes the outer face 22 of the first layer 12 and the lowermost surface of the third sheet 30 becomes the inner face 24 of the first layer 12.

The second layer 14 of the ballistic protection material is manufactured as follows.

An adhesive, for example epoxy resin, is used to adhere the second sheet 40 to the third sheet 42. Similarly, an adhesive, for example epoxy resin is used to adhere the first sheet 38 to the second sheet 40. The uppermost surface of the first sheet 38 thus becomes the outer face 34 of the second layer 14 and the lowermost surface of the third sheet 42 becomes the inner face 36 of the second layer 14.

The third layer 16 of the ballistic protection material 10 is manufactured by using a confining support frame or mould shaped to receive a mixture created to form the third layer 16. The support frame or mould is shaped such as to define an outer periphery of a mould to which the third layer will be moulded so as to define the outer periphery of a moulded tile which is then to be used to create the third layer by arranging a plurality of said tiles relative to each other as described herein. The support frame or mould acts as a restraining force against the action of a compression ram which is used to compact the particulate material during the manufacturing process which is conducted as follows.

Particles 64 of the ceramic material are mixed with a first component of an epoxy resin and mixed until the outer surface of the particles 64 is covered with the first component of the epoxy resin. A second component of the epoxy resin is mixed with the particles 64 to form a cream or paste. A first layer of the cream or paste is added to the support frame (not shown). A first sheet of metal mesh 58 is placed on top of the first layer of the cream or paste. A second layer of the cream or paste is added on top of the first sheet of metal mesh 58. A second sheet of metal mesh 58 is placed on top of the second layer of the cream or paste. A third layer of the cream or paste is added on top of the second sheet of metal mesh 58. A third sheet of metal mesh 58 is placed on top of the third layer of the cream or paste. The process is repeated until ten alternate layers of cream or paste and metal mesh have been placed in the support frame. The number of layers of mesh sheet 58 and epoxy resin-coated particles 64 are selected according to the specific threat environment of the application for which the ballistic protection material 10 is to be used.

A panel (not shown) is placed on the top layer and the combination of metal mesh and particulate ceramic is compressed under a weight sufficient to compact the mixture but preferably of at least 12 tonnes and more preferably at least 50 tonnes, for example up to 150 tonnes for between 3 and 4 hours to allow the epoxy resin matrix to cure.

The third layer 16 is then removed from the support frame.

The backing layer 68 is manufactured by adhering the first sheet 74 of the backing layer to the second sheet 76 of the backing layer such that the upper surface of the first sheet 74 of the backing layer 68 forms the outer face 70 of the backing layer. The lower surface of the third sheet 78 of the backing layer 68 forms the inner face of the backing layer.

Assembly of the ballistic protection material 10 from the first layer 12, the second layer 14, the third layer 16 and the backing layer 68 is as follows.

The third sheet 78 of the backing layer 68 is placed in a tape frame (not shown). The first and second layers 74, 76 of the backing layer (which have been adhered together) are placed on top of the third sheet 78 of the backing layer 68.

The third layer 16 is adhered to the backing layer 68 with an adhesive, for example an epoxy resin, such that the inner face 52 of the third layer 16 is adhered to the outer face 70 of the backing layer 68.

The second layer 14 is adhered to the third layer 16 with an adhesive, for example an epoxy resin, such that the inner face 36 of the second layer 14 is adhered to the outer face 50 of the third layer 16. The first layer 12 is positioned on top of the second layer 14 such that the inner face 24 of the first layer is in contact with the outer face 34 of the second layer.

The tape frame holds each of the first layer 12, the second layer 14, the third layer 16 and the backing layer 68 in position around the peripheral edges of the ballistic protection material 10.

Use of the ballistic protection material 10 will now be described.

In use, the ballistic protection material 10 is oriented such that the outer face 18 faces outwardly and the inner face 20 faces inwardly. In examples of the invention, in which the material is used for body armour, the outer face 18 is distal relative to a wearer's body and the inner face 20 is proximal relative to a wearer's trauma plates or pads, which are proximal to the wearer's body. In alternative examples of the invention, in which the material is used for vehicle armour, the outer face 18 is provided on an exterior surface of the vehicle and the inner face 20 is positioned within the wall of the vehicle.

In the event that a projectile contacts the ballistic protection material 10, the first, or outer, layer 12 comprising overlapping panels of carbon steel having a high tensile strength cause the outer casing or jacket of the bullet to be removed by means of shredding.

In the case of non-armour piercing ammunition, the second layer 14 acts to slow and stop the bullet. In the case of armour piercing ammunition, the pin (or penetrator) continues to travel towards the second layer 14 and towards the third layer 16, in which the combination of the dense and hard metal mesh and hard particulate ceramic act to further slow, and even stop or snap, the pin/penetrator.

The combination of the different classes or types of steel, with the mesh and particulate ceramic, provides a material that has the required mechanical properties to resist ballistic threats, but is less heavy, whilst also being resilient against ballistic threats.

The invention has undergone several ballistic tests related to levels of the European EN1522/1523 Ballistic Standards and NATO STANAG 4569 standards. The invention has successfully defended against normal and armour piercing ammunition within these standards.

Those skilled in the art will appreciate that the first material/layer may be selected from the list: carbon steel, high carbon steel, carbon fibre, ultra-high-molecular-weight-polyethylene (UHMWPE). They will also appreciate the second material/layer may be selected from the list: carbon steel, high carbon steel, carbon fibre, ultra-high-molecular-weight-polyethylene (UHMWPE).

Although the ballistic protection material 10 has been described with reference to schematic representations of the material in which a sample of the material is generally cuboidal, it will be understood that, in use, the material will be shaped according to its required application.

Examples of applications for use of the ballistic protection material 10 include:

Body armour

Building material e.g. door

Vehicle panel

The invention claimed is:

1. A ballistic protection material having a composite layer comprising a mesh embedded in a mass of compacted particulate material bound together by a binder material, wherein the binder material is a matrix and wherein the mesh and the compacted particulate material are embedded in the matrix, wherein the matrix consists essentially of a polymer.

2. The ballistic protection material as claimed in claim 1, wherein the mesh comprises at least one sheet of mesh and the at least one sheet of mesh includes a plurality of filaments.

3. The ballistic protection material as claimed in claim 1, wherein the mesh comprises a plurality of sheets of mesh.

4. The ballistic protection material as claimed in claim 2, wherein the plurality of filaments within at least one sheet of mesh are connected together.

5. The ballistic protection material as claimed in claim 1, wherein the mesh is a metal mesh or a metal alloy mesh.

6. The ballistic protection material as claimed in claim 1, wherein the plurality of filaments of the at least one sheet of mesh are metal wires with a diameter of at least 0.25 millimetres.

7. The ballistic protection material as claimed in claim 1, wherein the compacted particulate material comprises particles made from a ceramic material.

8. The ballistic protection material as claimed in claim 1, wherein the compacted particulate material comprises particles made from aluminium oxide.

9. The ballistic protection material as claimed in claim 8, wherein the average particle size of the particles is at least 0.25 millimetres, or wherein the average particle size of the particles is less than 0.90 millimetres.

10. The ballistic protection material as claimed in claim 8, wherein the particles of aluminium oxide are generally spherical or wherein the particles of aluminium oxide are angular.

11. The ballistic protection material as claimed in claim 1, wherein the mesh is a metal mesh, wherein the compacted particulate material comprises ceramic particles, wherein the binder material is a matrix and wherein the metal mesh and the ceramic particles are embedded in the matrix.

12. The ballistic protection material as claimed in claim 11, wherein the polymer is a cured resin.

13. The ballistic protection material as claimed in claim 1 having a first layer comprising a first material, a second layer comprising a second material and a third layer comprising the composite layer.

14. The ballistic protection material as claimed in claim 13, wherein the second layer is positioned intermediate the first layer and the third layer.

15. The ballistic protection material as claimed in claim 13, wherein the first layer includes a plurality of partially overlapping panels of the first material.

16. The ballistic protection material as claimed in claim 15, wherein the plurality of partially overlapping panels of the first material are arranged in two or more overlaid sheets.

17. The ballistic protection material as claimed in claim 13, wherein the first material of the first layer comprises a first class of steel, and the second material of the second layer comprises a second class of steel that is different to the first class of steel.

18. The ballistic protection material as claimed in claim 13, wherein the second layer includes a plurality of sheets of the second material.

19. The ballistic protection material as claimed in claim 13, wherein the first layer has a first thickness, the second layer has a second thickness, and wherein a ratio of the first thickness to the second thickness is 1:2, and/or wherein the third layer has a third thickness and a ratio of the second thickness to the third thickness is 1:2; and/or wherein a ratio of the first thickness to the third thickness is 1:4.

20. The ballistic protection material as claimed in claim 19, wherein the first thickness is 5 millimetres, and/or wherein the second thickness is 10 millimetres; and/or wherein the third thickness is 20 millimetres.

* * * * *